US005606967A

United States Patent [19]

Wang

[11] Patent Number: 5,606,967

[45] Date of Patent: Mar. 4, 1997

[54] MASK AND SNORKEL ASSEMBLY

[76] Inventor: Daniel Wang, 10F, No. 15, Sec. 2, Chilung Road, Taipei, Taiwan

[21] Appl. No.: 566,087

[22] Filed: Dec. 1, 1995

[51] Int. Cl.[6] ..... A22B 7/00

[52] U.S. Cl. ..... 128/201.11; 128/200.29; 128/201.27; 128/201.28; 128/202.14

[58] Field of Search ..... 128/201.11, 201.27, 128/201.28, 202.14, 205.24, 200.29

[56] References Cited

U.S. PATENT DOCUMENTS

| | | | |
|---|---|---|---|
| 1,331,601 | 2/1920 | Watanabe | 128/201.28 |
| 2,317,237 | 4/1943 | Wilen | 128/201.11 |
| 3,951,142 | 4/1976 | Martin | 128/201.11 |
| 4,269,182 | 5/1981 | Le | 128/201.11 |
| 5,351,681 | 10/1994 | Hudson | 128/201.11 |

FOREIGN PATENT DOCUMENTS

| | | | |
|---|---|---|---|
| 1139978 | 7/1957 | France | 128/201.11 |
| 1177002 | 4/1959 | France | 128/201.11 |
| 2148128 | 5/1985 | United Kingdom | 128/201.11 |

*Primary Examiner*—V. Millin
*Assistant Examiner*—V. Srivastava
*Attorney, Agent, or Firm*—Merchant, Gould, Smith, Edell, Welter & Schmidt, P.A.

[57] ABSTRACT

A mask and snorkel assembly including a float having a circular center recess and a center through hole at the center of the center recess, a snorkel retained in the center recess of the float by a locating block thereof and having a top end turned down and mounted with a ball valve and a bottom end inserted through the center hole of the float, a mask for covering over the eyes and the nose and having an air tube at the top, and an air hose connected between the bottom end of the snorkel and the air tube of the mask, wherein the ball valve is forced upwards by water to close the air passage of the snorkel when the top end of the snorkel is pulled under water.

2 Claims, 14 Drawing Sheets

MASK AND SNORKEL ASSEMBLY

BACKGROUND OF THE INVENTION

The present invention relates to masks for diving, and relates more particularly to such a mask and snorkel assembly which has a ball valve in the snorkel to prevent water from entering the mask.

Surface diving has become one of the most invited water sports during the summer holidays. For surface diving, a mask with a snorkel shall be used. Regular masks for surface diving commonly have a short snorkel for breathing. However, because of the limitation of the snorkel, a deep diving is not allowed. Furthermore, the snorkel cannot prohibit water from entering the mask if it is pulled under water.

SUMMARY OF THE INVENTION

The present invention has been accomplished to provide a mask and snorkel assembly which eliminates the aforesaid drawbacks. It is one object of the present invention to provide a mask and snorkel assembly which allows the user to submerge under water at a deep distance. It is another object of the present invention to provide a mask and snorkel assembly which has means to stop water from entering the mask.

According to one aspect of the present invention, the mask and snorkel assembly comprises a float, the float comprising a circular center recess, an inside annular groove around the circular center recess, a center through hole at the center of the circular center recess; a snorkel having a top end turned down and terminating in a top opening, a bottom end inserted through the center through hole of the float and terminating in a bottom opening, an air passage connected between the top opening and the bottom opening, a wire gauze filter covered on the top opening, a ball valve mounted in the bottom opening and supported on the wire gauze filter for letting air pass through the air passage, and a locating block inserted into the circular center recess and forced into engagement with the inside annular groove to retain the snorkel to the float, the ball valve being moved upwards by water to close the air passage when the top opening is pulled under water; a mask for covering over the eyes and the nose, the mask having an air tube at a top side; and an air hose having a first end connected to the bottom opening of the snorkel, and a second end connected to the air tube of the mask. According to another aspect of the present invention, the air tube of the mask is coupled with a control valve, and the second end of the air hose is coupled with a control valve detachably connected to the control valve of the air tube of the mask by a screw joint. According to still another aspect of the present invention, the mask comprises an accumulation chamber at a bottom side for gathering water, and a control valve mounted in a bottom hole on the accumulation chamber to control its passage. According to still another aspect of the present invention, each of the control valves comprises a cylindrical casing having a flexible circular chamber at one side and a flexible flank at an opposite side and defining an air passage through its length, and a spherical valve means mounted on the inside to control the air passage through the cylindrical casing, the spherical valve means being forced into the circular chamber to open the air passage of the cylindrical casing when the flank is squeezed, the spherical valve means being forced out of the circular chamber to close the air passage of the cylindrical casing when the circular chamber is squeezed.

DETAILED DESCRIPTION OF THE PREFERRED EMBODIMENT

Figure 1:
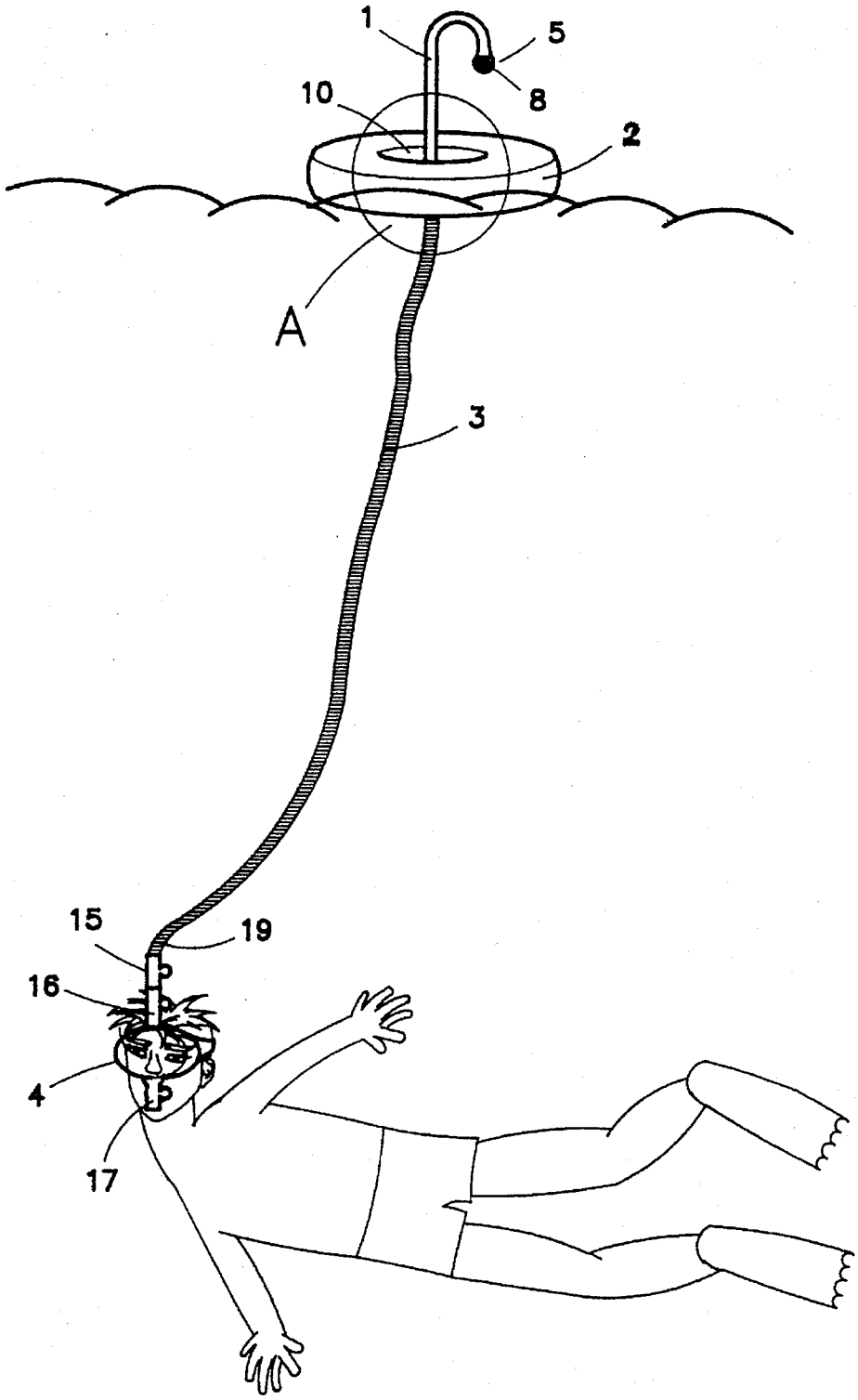
FIG. 1 is a plain view of the mask and snorkel assembly according to the present invention, showing the float floated in water and the mask fastened to the surface diver.
Figure 1A:
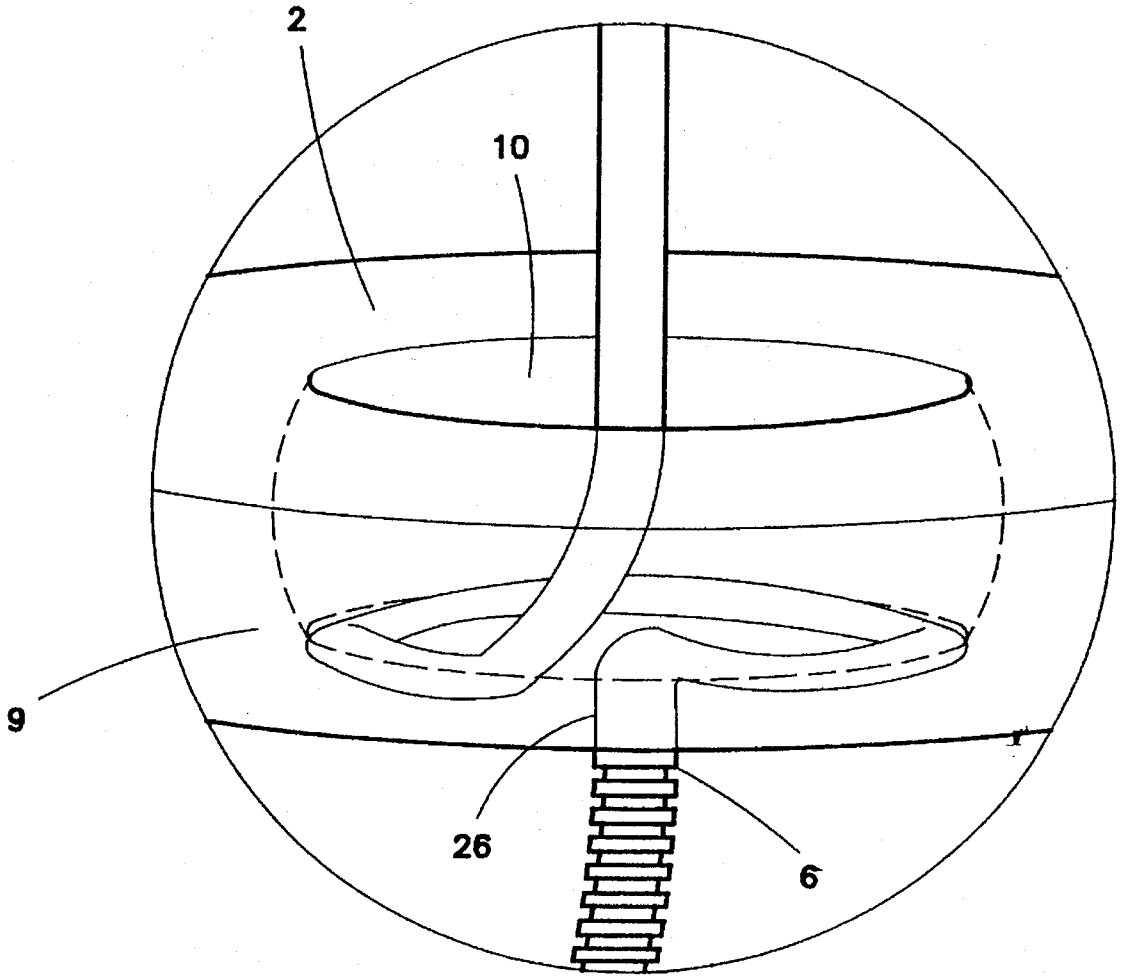
FIG. 1A is a perspective view in an enlarged scale of part A of FIG. 1.
Figure 3:
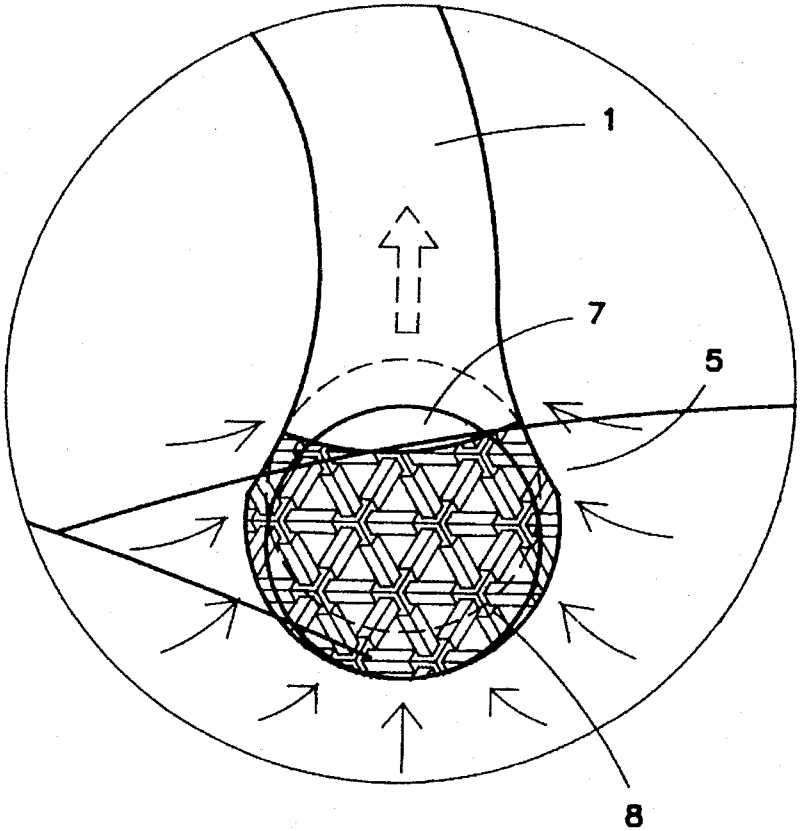
FIG. 3 is similar to FIG. 2 but showing the moving direction of the ball valve.
Figure 2:
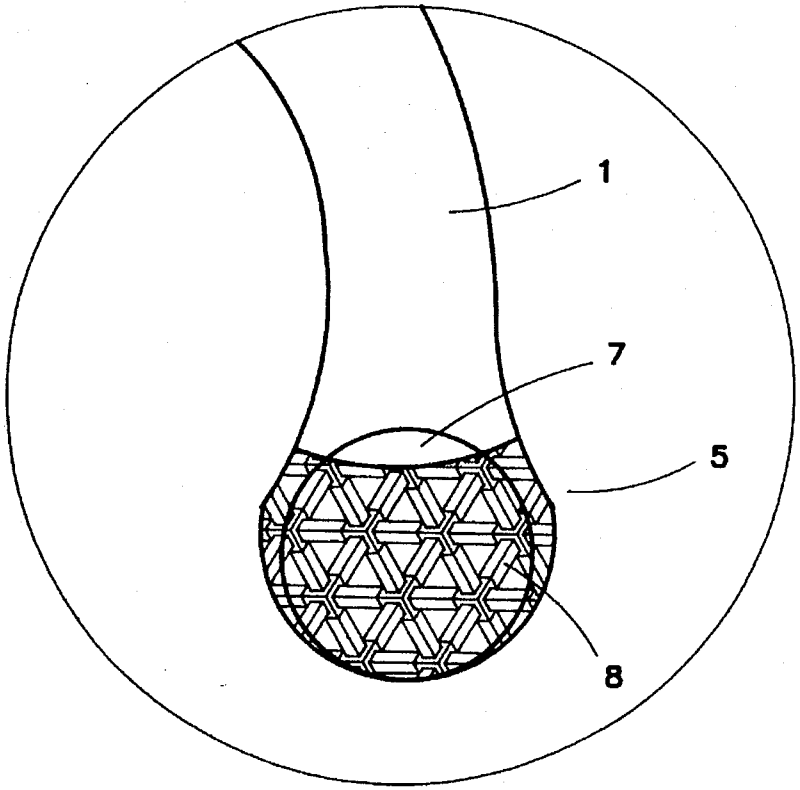
FIG. 2 is an enlarged-view of the top end of the snorkel, showing the ball valve supported on the wire gauze filter and the air passage of the snorkel opened.
Figure 4:
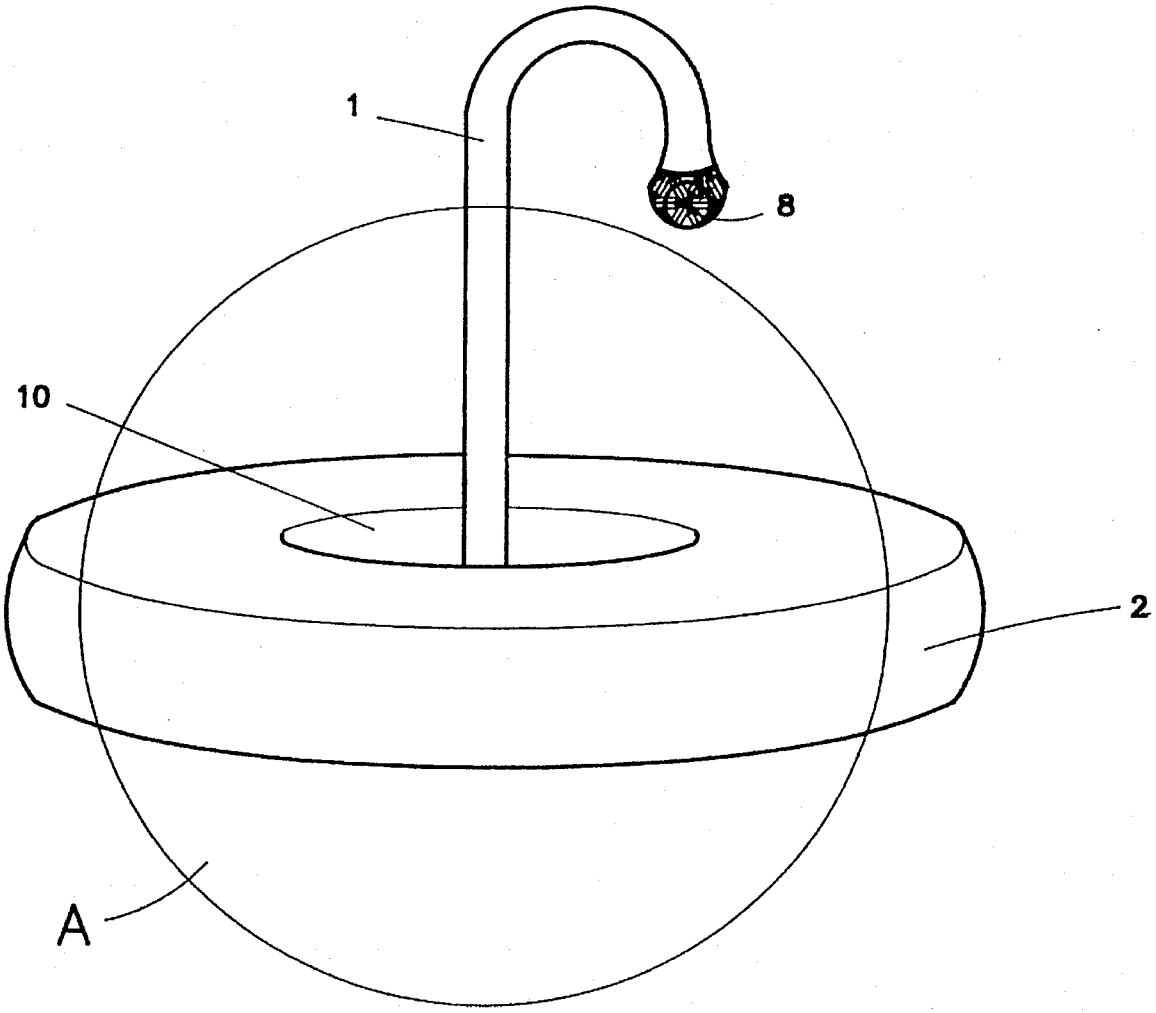
FIG. 4 is an enlarged view of the upper part of FIG. 1.
Figure 4A:
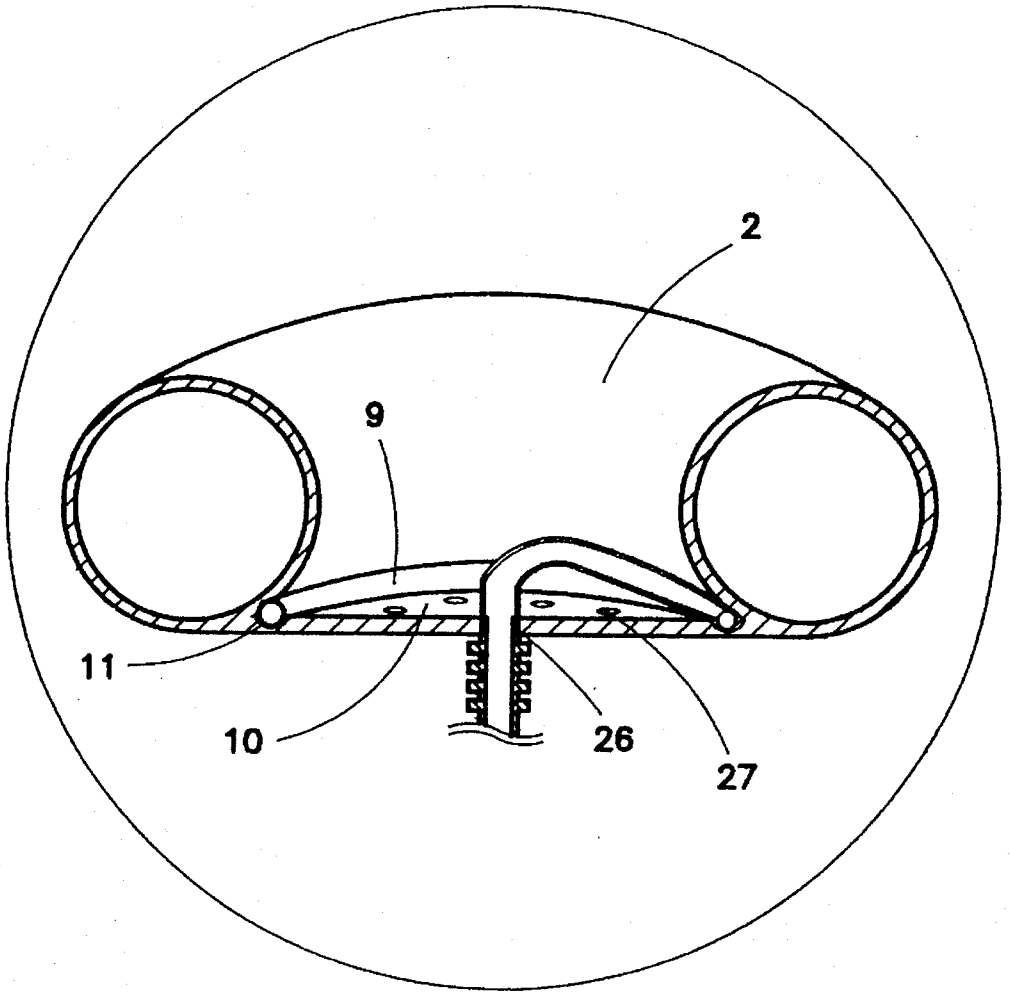
FIG. 4A is a sectional view in an enlarged scale of part A of FIG. 4.

Referring to FIGS. 1, 1A, 2, 3, 4, and 5, a mask and snorkel assembly in accordance with the present invention is generally comprised of a snorkel 1, a float 2, an air hose 3, and a mask 4. The snorkel 1 is made from a tube having two openings, namely, the top opening 5 and the bottom opening 6 at two opposite ends. The snorkel 1 defines an air passage connected between the top opening 5 and the bottom opening 6. The top end of the snorkel 1 is made of curved shape with the top opening 5 turned down and mounted with a ball valve 7. A wire gauze filter 8 is fastened to the top opening 5 of the snorkel 1 to hold the ball valve 7 inside the opening 5 (see FIG. 2). Normally, the ball valve 7 is supported on the wire gauze filter 8, and the top opening 5 is in the open status. If the ball valve 7 floats upwards, it immediately stops the top opening 5 of the snorkel 1 (see the dotted line in FIG. 3). The snorkel 1 further comprises a locating block 9 on the outside for fastening to the float 2 (see FIG. 1A). The float 2 is made of circular shape having a circular center recess 10, an inside annular groove 11 around the circular center recess 10, a center through hole 26 at the center of the circular center recess 10, and a plurality of drain holes 27 at the circular center recess 10 for carrying off water from the float 2. When the bottom end of the snorkel 1 is inserted into the center through hole 26 of the float 2, the locating block 9 is inserted into the circular center recess 10 and then forced into engagement with the inside annular groove 11 (see FIGS. 4 and 4A). The mask 4 comprises a nose covering 12 for covering over the user's nose, a transparent eyepiece 13 for covering over the user's eyes, an air tube 18 extending upwards from the transparent eyepiece 13 for guiding air to the inside of the nose covering 12 through the inside of the eyepiece 13, two fastening belts 14 for fastening the mask 4 to the user's head. The air hose 3 is connected between the bottom opening 6 of the snorkel 1 and the air tube 18 of the mask 4.

Figure 9:
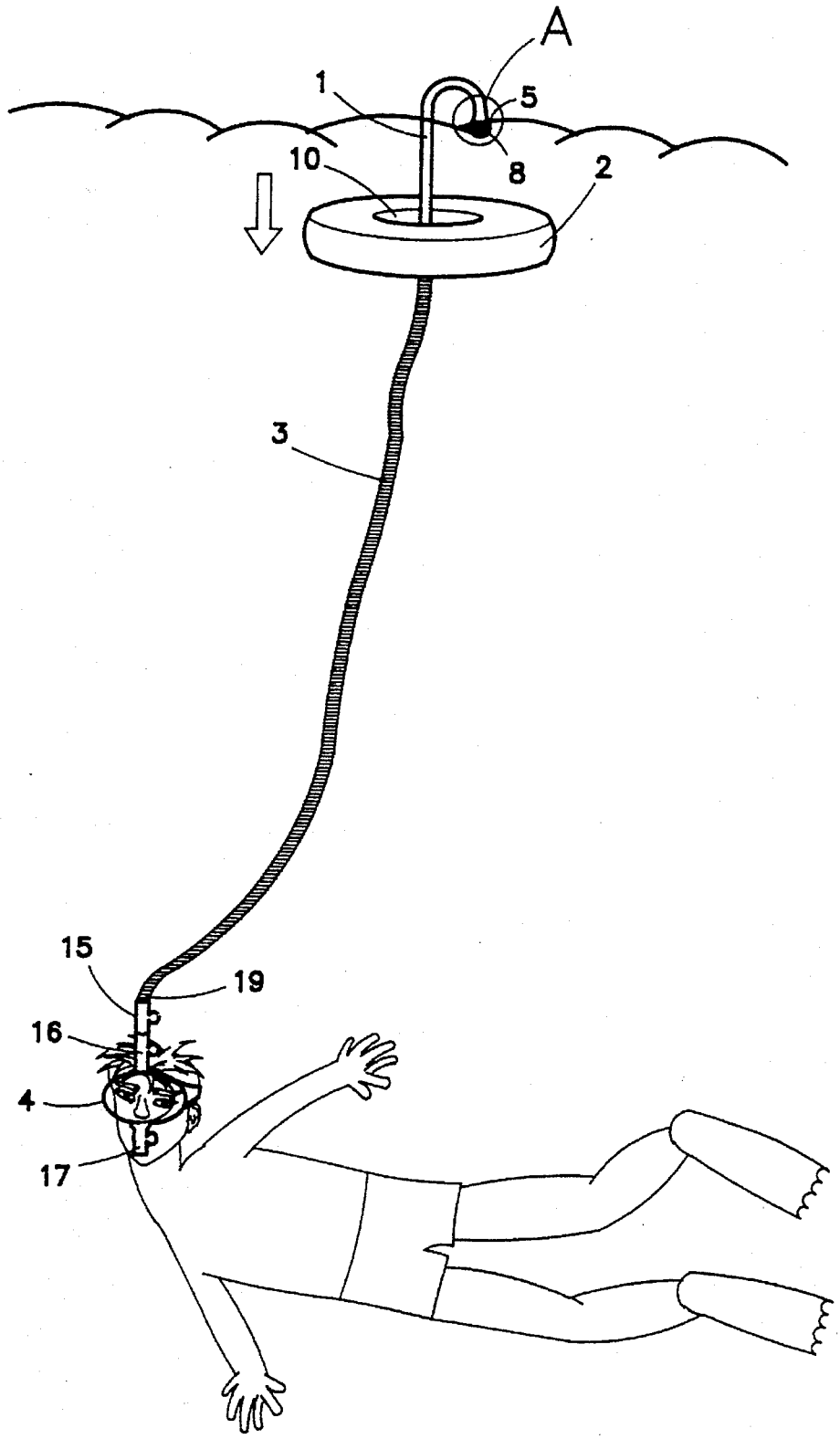
FIG. 9 shows the float and the top end of the snorkel pulled under water.
Figure 9A:
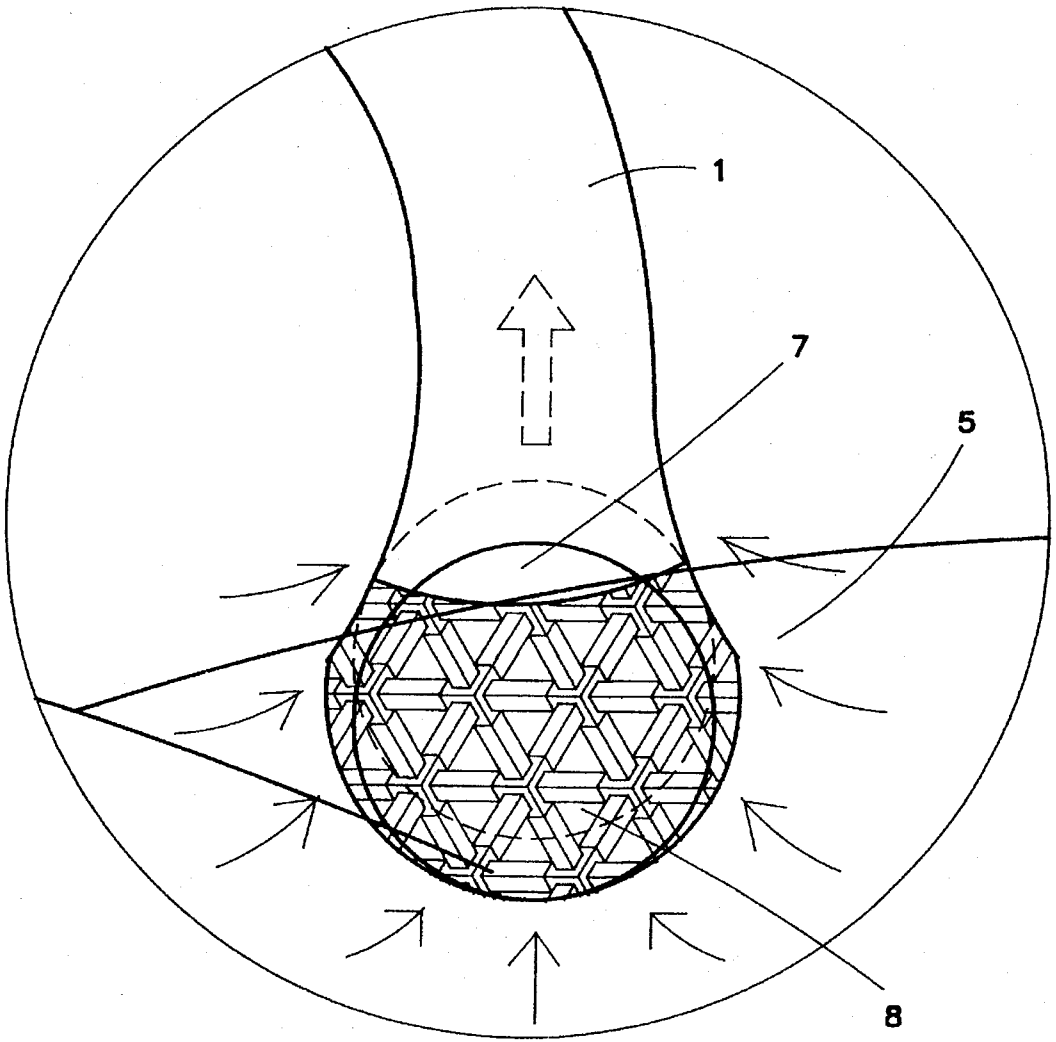
FIG. 9A is an enlarged view of part A of FIG. 9.
Figure 10:
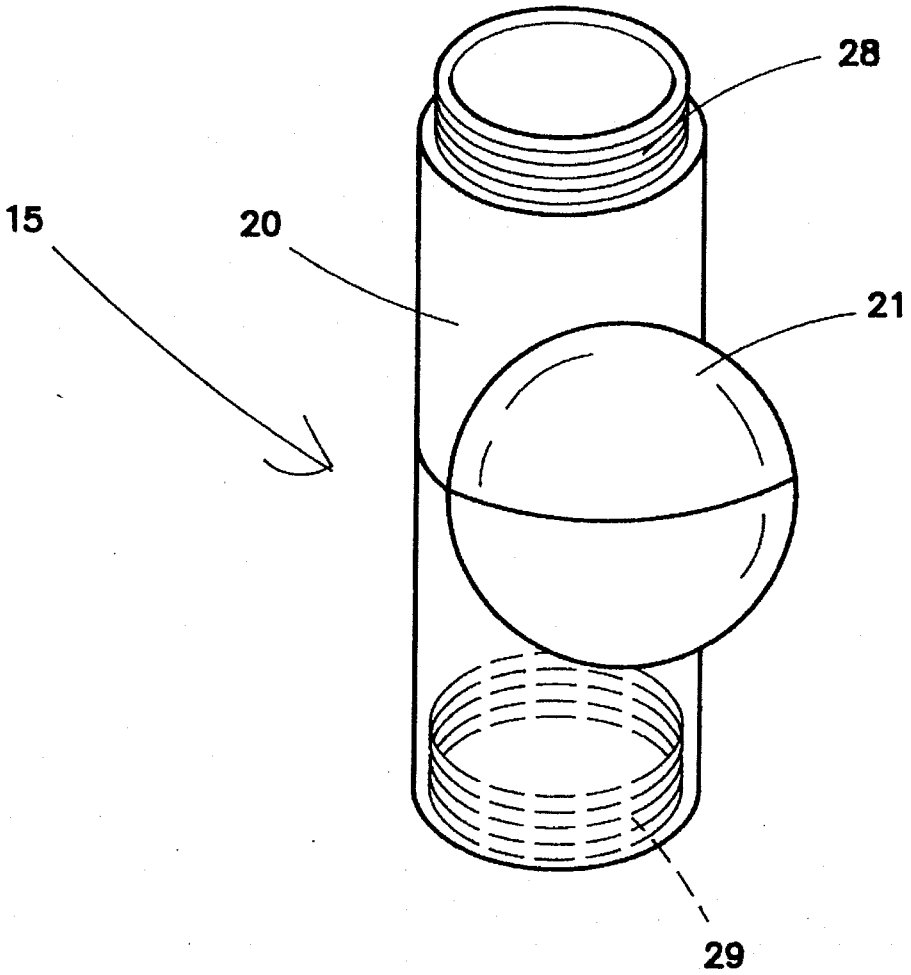
FIG. 10 is a perspective view of the control valve according to the present invention.
Figure 11:
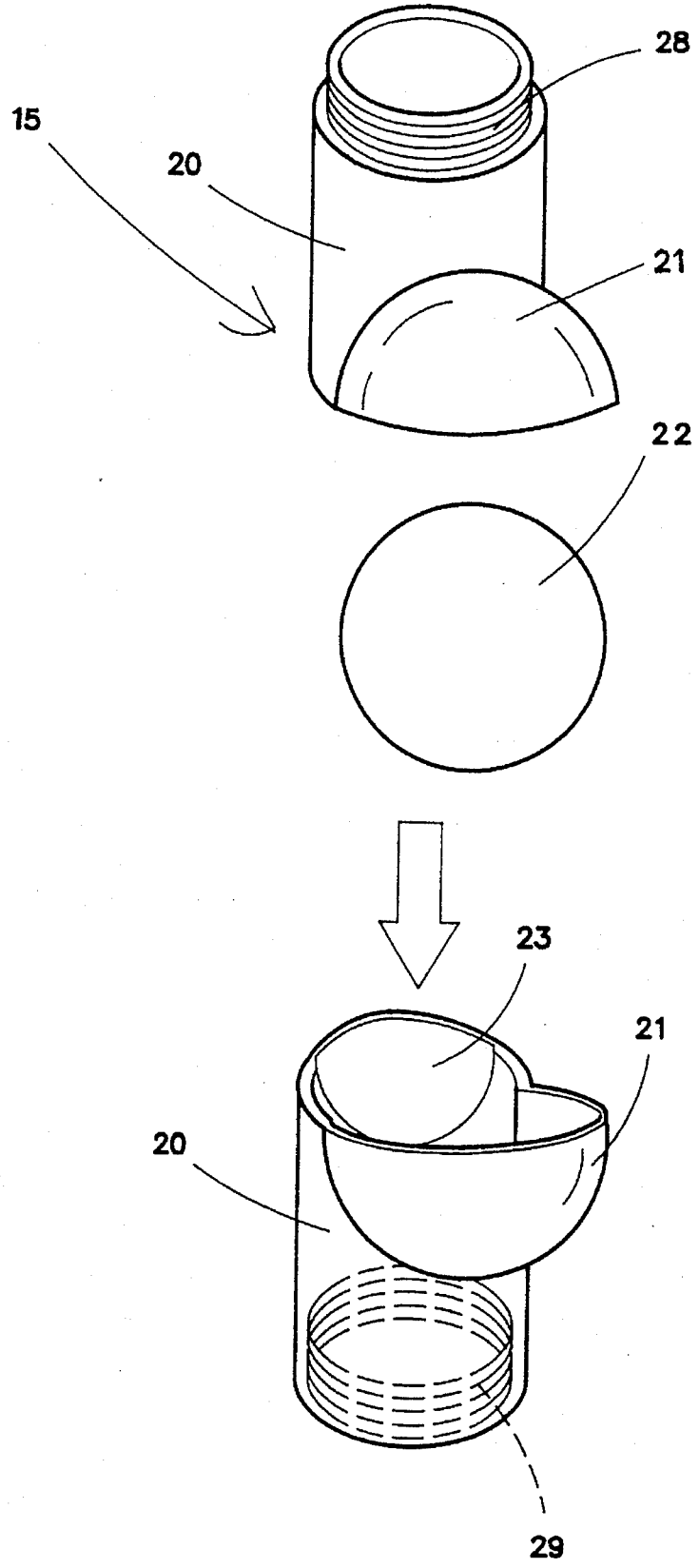
FIG. 11 is an exploded view of the control valve according to the present invention.

Referring to FIGS. 9 and 9A, and FIG. 1 again, during diving, the snorkel 1 is maintained above water by the float 2. If the swimmer submerges too deep from the surface, the float 2 will be pulled into the water, causing the ball valve 7 to stop the top opening 5 of the snorkel 1 to prevent water from entering the mask 4 through the air hose 3.

Referring to FIG. 5 again, a control valve 15 is fastened to the bottom end of the air hose 3 for connection to a control valve 16, which is fastened to the air tube 18 of the mask 4. When the control valve is disconnected from the control valve 16, the control valve 16 can be closed to stop water from entering the mask 4. The mask 4 further comprises an accumulation chamber 25 at the bottom side, and a control valve 17 connected to the bottom hole 24 of the accumulation chamber 25 for carrying off water from the accumulation chamber 25.

Figure 12:
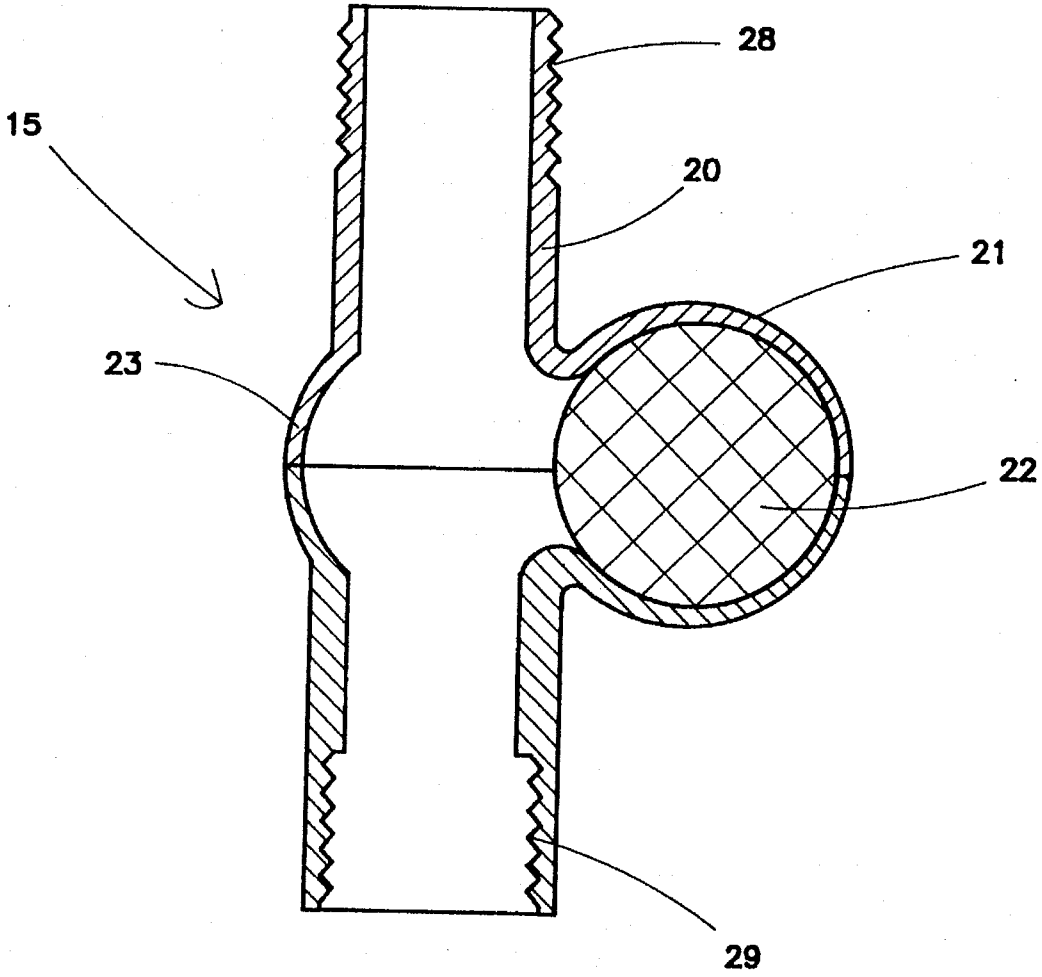
FIG. 12 is a longitudinal view in section of the control valve according to the present invention.

Referring to FIGS. 10, 11, 12, and 5 again, the control valves 15, 16, and 17 are of the same structure, each comprising a cylindrical casing 20 defining an air passage through its length, an outer thread 28 and an inner thread 29 at two opposite ends for mounting, a circular chamber 21 at one side, a ball valve 22 mounted inside the circular chamber 21, and flank 23 opposite to the circular chamber 21 (see FIG. 12). The circular chamber 21 and the flank 23 are made from elastic material, for example, rubber. The circular chamber 21, the flank 23, and the cylindrical casing 20 can be molded from same material and made in two symmetrical halves, and then the two symmetrical halves are fastened together by a high-frequency heat sealing apparatus after the installation of the ball valve 22. Alternatively, the circular chamber 21 and the flank 23 are separately made from one material, and then fixedly secured to the cylindrical casing 20, which is made from a different material. The ball valve 22 is made from rigid, friction-resisting, high density material of rounded shape. When the circular chamber 21 is squeezed, the ball valve 22 is forced out of the circular chamber into the space between the circular chamber 21 and the flank 23 to stop the passage through the cylindrical casing 20. When the flank 23 is squeezed, the ball valve 22 is forced back into the circular chamber 21, and therefore the passage through the cylindrical casing 20 is opened again.

Figure 5:
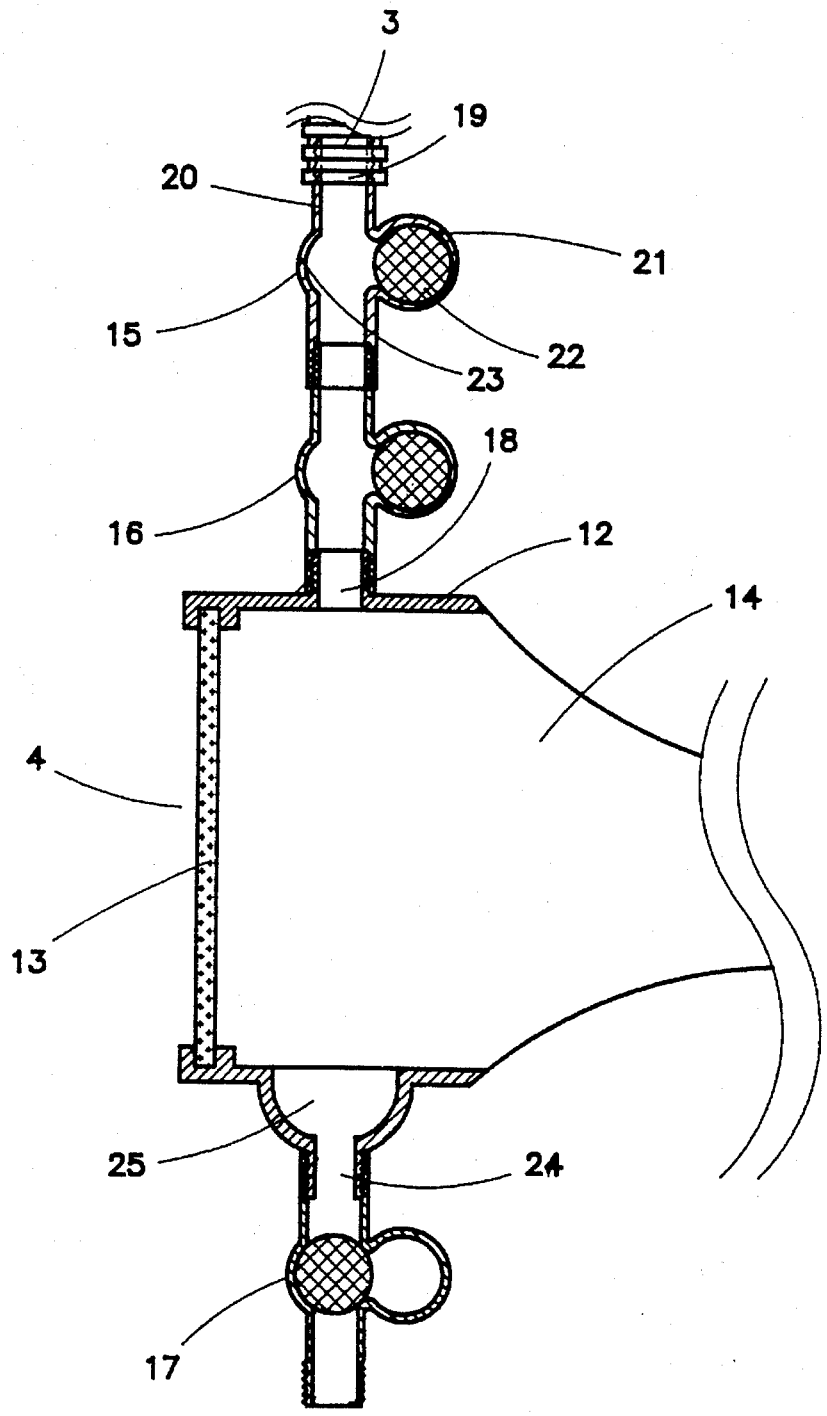
FIG. 5 is a sectional view in an enlarged scale of the mask according to the present invention.
Figure 6:
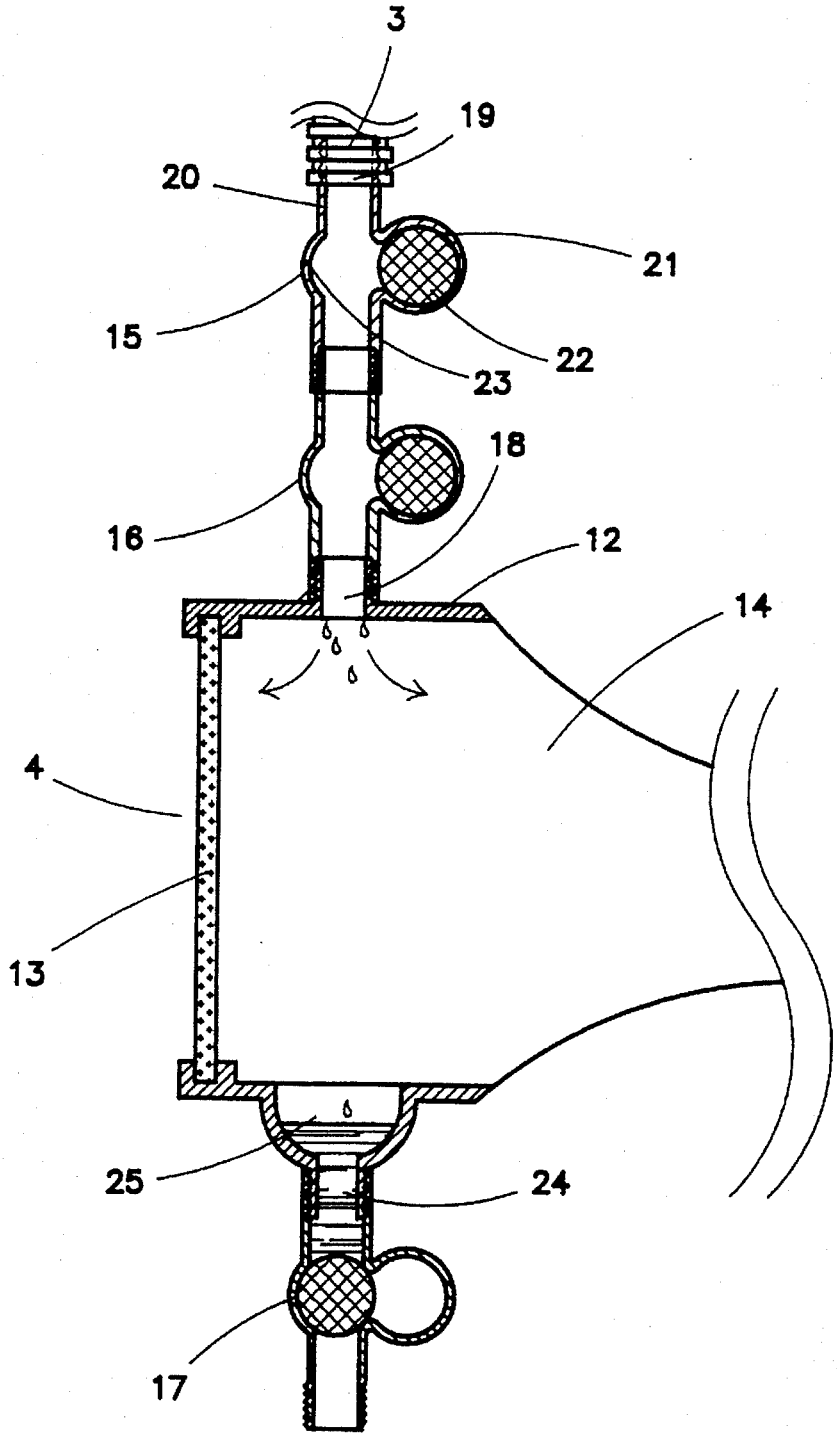
FIG. 6 is similar to FIG. 5 but showing water gathered in the accumulation chamber.
Figure 7:
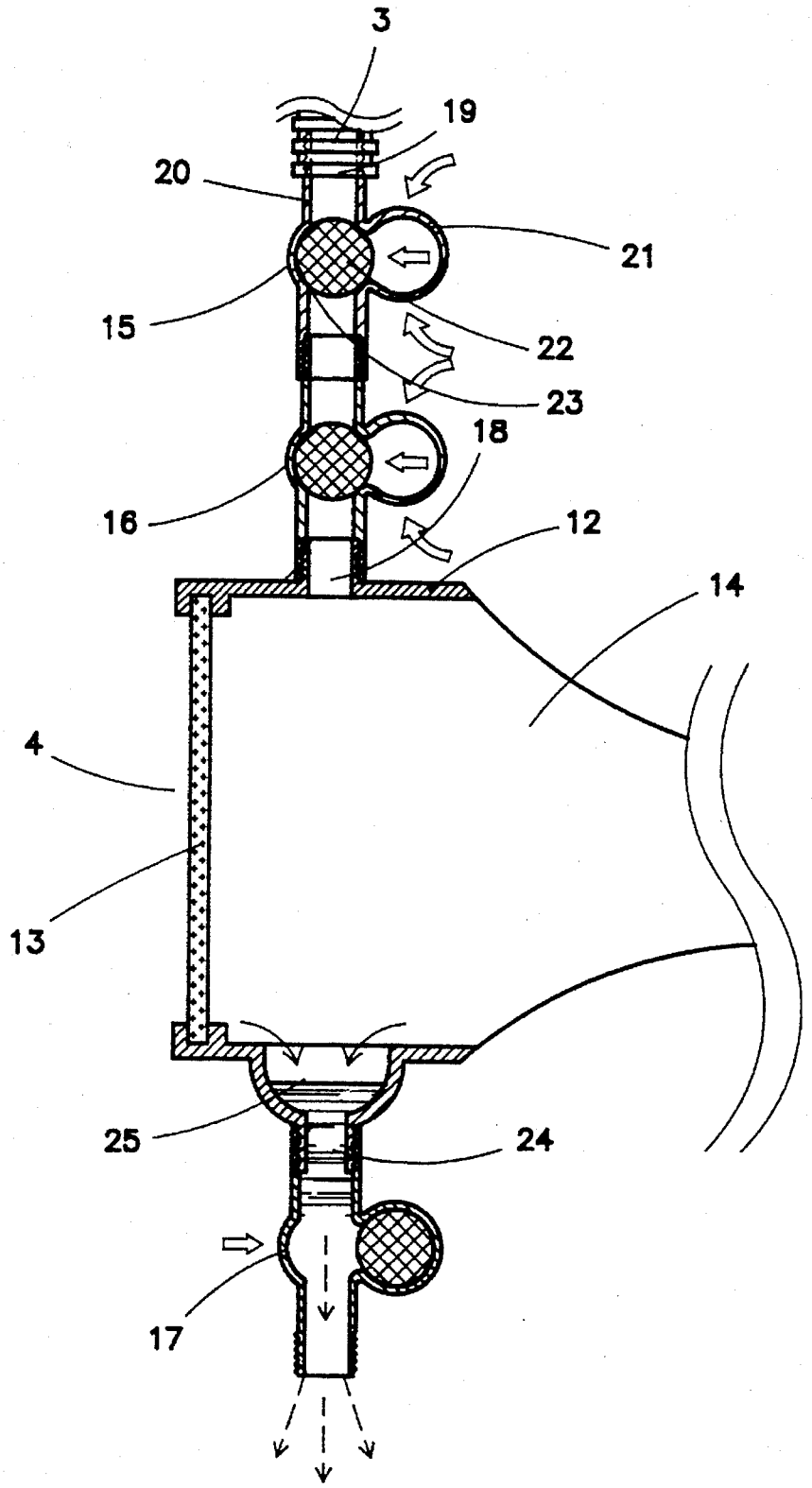
FIG. 7 is similar to FIG. 6 but showing the control valve of the mask opened, and water forced out of the accumulation chamber.
Figure 8:
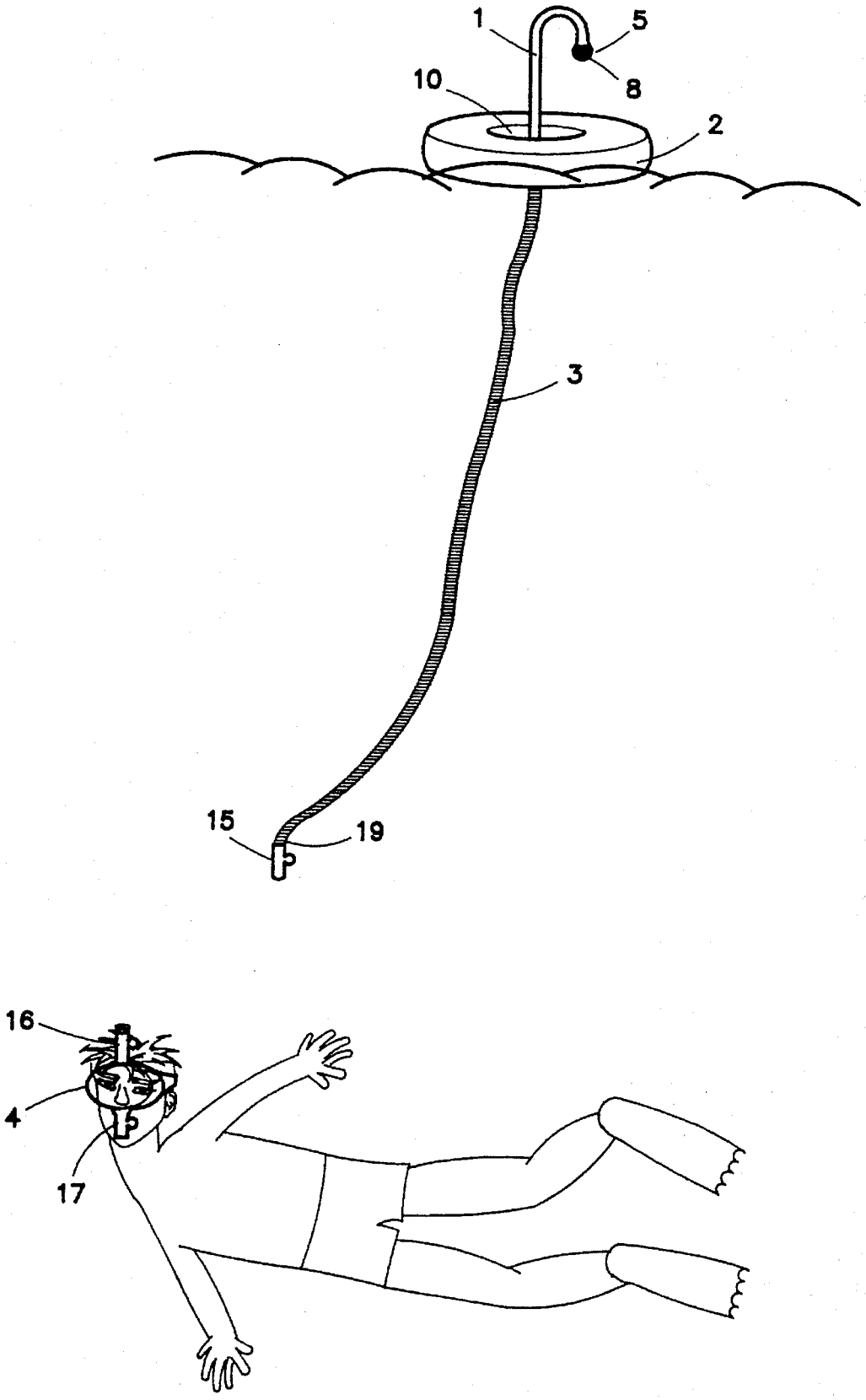
FIG. 8 shows the mask disconnected from the air hose according to the present invention.

During surface diving, the control valves 15 and 16 are opened to let air pass from the snorkel 1 and the air hose 3 into the mask 4, and the control valve 17 is closed to prohibit water from entering the mask 4 (see FIG. 5). If water enters the mask 4, it will be gathered in the accumulation chamber 25 (see FIG. 6). When the control valve 17 is opened, water can be forced out of the accumulation chamber 25 by breathing forth air (see FIG. 7). If the air hose 3 is jammed in an object, the mask 4 can be disconnected from the air hose 3 by closing the control valves 15 and 16 and the disconnecting them from each other.

It is to be understood that the drawings are designed for purposes of illustration only, and are not intended as a definition of the limits and scope of the invention disclosed.

I claim:

1. A mask and snorkel assembly, comprising:

a float, said float comprising a circular center recess, an inside annular groove around said circular center recess, a center through hole at the center of said circular center recess;

a snorkel having a top end turned down and terminating in a top opening, a bottom end inserted through the center through hole of said float and terminating in a bottom opening, an air passage connected between said top opening and said bottom opening, a wire gauze filter covered on said top opening, a ball valve mounted in said top opening and supported on said wire gauze filter for letting air pass through said air passage, and locating block inserted into the circular center recess and forced into engagement with said inside annular groove to retain said snorkel to said float, said ball valve being moved upwards by water to close said air passage when said top opening is pulled under water;

a mask for covering over the eyes and the nose, said mask having an air tube at a top side;

an air hose having a first end connected to the bottom opening of said snorkel, and a second end connected to the air tube of said mask;

wherein the air tube of said mask is coupled with a control valve, the second end of said air hose is coupled with a control valve detachably connected to the control valve of the air tube of said mask by a screw joint; and wherein each control valve comprises a cylindrical casing having a flexible circular chamber at one side and a flexible flank at an opposite side and defining an air passage through its length, and a spherical valve means mounted on the inside to control the air passage through said cylindrical casing, said spherical valve means being forced into said circular chamber to open the air passage of said cylindrical casing when said flank is squeezed, said spherical valve means being forced out of said circular chamber to close the air passage of said cylindrical casing when said circular chamber is squeezed.

2. A mask and snorkel assembly, comprising;

a float, said float comprising a circular center recess, an inside annular groove around said circular center recess, a center through hole at the center of said circular center recess;

a snorkel having a top end turned down and terminating in a top opening, a bottom end inserted through the center through hole of said float and terminating in a bottom opening, an air passage connected between said top opening and said bottom opening, a wire gauze filter covered on said top opening, a ball valve mounted in said top opening and supported on said wire gauze filter for letting air pass through said air passage, and a locating block inserted into the circular center recess and forced into engagement with said inside annular groove to retain said snorkel to said float, said ball valve being moved upwards by water to close said air passage when said top opening is pulled under water;

a mask for covering over the eyes and the nose, said mask having an air tube at a top side;

an air hose having a first end connected to the bottom opening of said snorkel, and a second end connected to the air tube of said mask;

wherein said mask comprises an accumulation chamber at a bottom side for gathering water, and a control valve mounted in a bottom hole on said accumulation chamber to control its passage; and wherein the control valve of said mask comprises a cylindrical casing having a flexible circular chamber at one side and a flexible flank at an opposite side and defining an air passage through its-length, and a spherical valve means mounted on the inside to control the air passage through said cylindrical casing, said spherical valve means being forced into said circular chamber to open the air passage of said cylindrical casing when said flank is squeezed, said spherical valve means being forced out of said circular chamber to close the air passage of said cylindrical casing when said circular chamber is squeezed.

* * * * *